US007063559B2

(12) United States Patent
Wang et al.

(10) Patent No.: US 7,063,559 B2
(45) Date of Patent: Jun. 20, 2006

(54) FLEXIBLE PRINTED CIRCUIT ELECTRICAL CONNECTOR

(75) Inventors: Haibo Wang, Kunsan (CN); Wei Yu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/101,026

(22) Filed: Apr. 6, 2005

(65) Prior Publication Data

US 2005/0287865 A1 Dec. 29, 2005

(30) Foreign Application Priority Data

Jun. 23, 2004 (CN) ..... 2004 2 0622054 U

(51) Int. Cl.
*H01R 12/24* (2006.01)

(52) U.S. Cl. ..... 439/495

(58) Field of Classification Search ..... 439/495, 439/260, 267, 492
See application file for complete search history.

(56) References Cited

U.S. PATENT DOCUMENTS 5,695,360 A * 12/1997 Seto et al. ..... 439/495
5,842,883 A * 12/1998 Igarashi et al. ..... 439/495
5,895,287 A * 4/1999 Seto et al. ..... 439/495
6,099,346 A * 8/2000 Hashiguchi et al. ..... 439/495
6,319,033 B1 * 11/2001 Ma ..... 439/260
6,352,442 B1 * 3/2002 Kudo ..... 439/260
6,471,541 B1 * 10/2002 Kunishi et al. ..... 439/495
6,533,606 B1 * 3/2003 Yamane ..... 439/495
6,755,682 B1 * 6/2004 Kunishi et al. ..... 439/495
6,767,233 B1 * 7/2004 Tsunematsu ..... 439/260

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

An electrical connector (1) is provided for connecting a flexible printed circuit to a print circuit board. The connector comprises an insulative housing (22), a number of electrical contacts (24) received in the insulative housing, a pair of metal ears (26) inserted into opposite lateral sides of the insulative housing and an actuator (28) assembled on the insulative housing via pivotally engaging with the metal ears. Each metal ear has a main body, an elastic arm (262) and a latch arm (264) to define a hole (265) together and a claw (266) for locking the actuator in a close position. The actuator has a board (280) and a pair of turning shafts (282) projecting from lateral sides of the board. When the turning shafts received in the holes of the metal ears, stretch tails (263) of the elastic arms abut against the turning shafts to retain the actuator.

20 Claims, 5 Drawing Sheets

FLEXIBLE PRINTED CIRCUIT ELECTRICAL CONNECTOR

BACKGROUND OF THE INVENTION

1. Field of the Invention

The present invention is generally related to an electrical connector, and more particularly, to an electrical connector used for connecting with a flexible print circuit board or a flexible ribbon cable.

2. Description of Related Art

A variety of flexible printed circuits are widely used in electronic devices, such as notebooks, mobile phones and fax machines. Various electrical connectors are adapted for connecting corresponding flexible printed circuits. There is a conventional flexible printed circuit connector disclosed in U.S. Pat. No. 5,842,883. The flexible printed circuit connector includes an insulative housing, a plurality of contacts and an actuator. The actuator defines an open position and a close position relative to the insulative housing, and brings the flexible printed circuits into contact with the contacts during a rotation from the open position to the close position. The insulative housing is formed with a pair of horizontal passages and a pair of horizontal slots on an inner face of sidewalls thereof. The actuator has a pair of turning shafts respectively set pivotally in said passages and a pair of projections respectively accepted in said slots for keeping the actuator in the close position. However, the configuration of the insulative housing is complex, and the projections of the actuator are easily destroyed during the actuator rotation to the close position, that brings the actuator become loose and the electrical connection between the flexible printed circuit connector and the flexible printed circuit become unreliable.

Another type of flexible printed circuit connector further includes a pair of metal ears inserted into opposite sidewalls of the insulative housing. Each metal ear has a first sidewall with a pivot portion at an end thereof, a second sidewall paralleled to the first sidewall for fixing the metal ear to the insulative housing and a bottom plate joining the first and second sidewalls. The actuator is assembled on the insulative housing by pivotally engaging with the pivot portion of the metal ears set on the insulative housing. But this arrangement of the actuator can not ensure the actuator in the close position reliable and that will influence the electrical connection between the flexible printed circuit connector and the flexible printed circuit.

Hence, an electrical connector is highly desired to overcome the aforementioned disadvantages of the prior art.

SUMMARY OF THE INVENTION

Accordingly, an object of the present invention is to provide an electrical connector, which prevents an actuator from loosing and has a reliable electrical connection between electrical contacts and a flexible printed circuit.

Another object of the present invention is to provide an electrical connector, which provides a pair of metal ears locking the actuator in a close position.

In order to achieve the object set forth, an electrical connector is provided. The electrical connector comprises an insulative housing, a plurality of electrical contacts received in the insulative housing, a pair of metal ears respectively inserted into lateral sides of the insulative housing and an actuator assembled on the insulative housing via the metal ears. The insulative housing defines a longitudinal direction and a mating direction perpendicular to the longitudinal direction and has a base portion and a mating portion extending forwardly along the mating direction from the base portion. Each metal ear stamped by a piece of metal has a main body, an elastic arm and a latch arm both extending from an upside of an end of the main body to define a hole together and a claw formed on the other end of the main body adjacent to an end of the mating portion away from the base portion in the mating direction. The actuator has an approximately rectangle board and a pair of turning shafts projecting from lateral sides of the board. The turning shafts are pivotally received in corresponding holes of the metal ears and abut against corresponding elastic arms of the metal ears. When a flexible printed circuit is inserted into the electrical connector, the actuator is rotated from an open position to a close position relative to the insulative housing to press the electrical contacts against the flexible printed circuit and achieve an electrical connecting between the electrical contacts and the flexible printed circuit. Finally, the claws of the metal ears lock the actuator in the close position reliably to prevent the actuator from loosing. During the process of the claw locking with the actuator, the claw of each metal ear and the actuator collide with each other in the mating direction. Since the elastic arms of the metal ears abutting against the turning shafts of the actuator are elastic, the actuator is allowed to move rearwardly and is prevented from destroying the claw.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
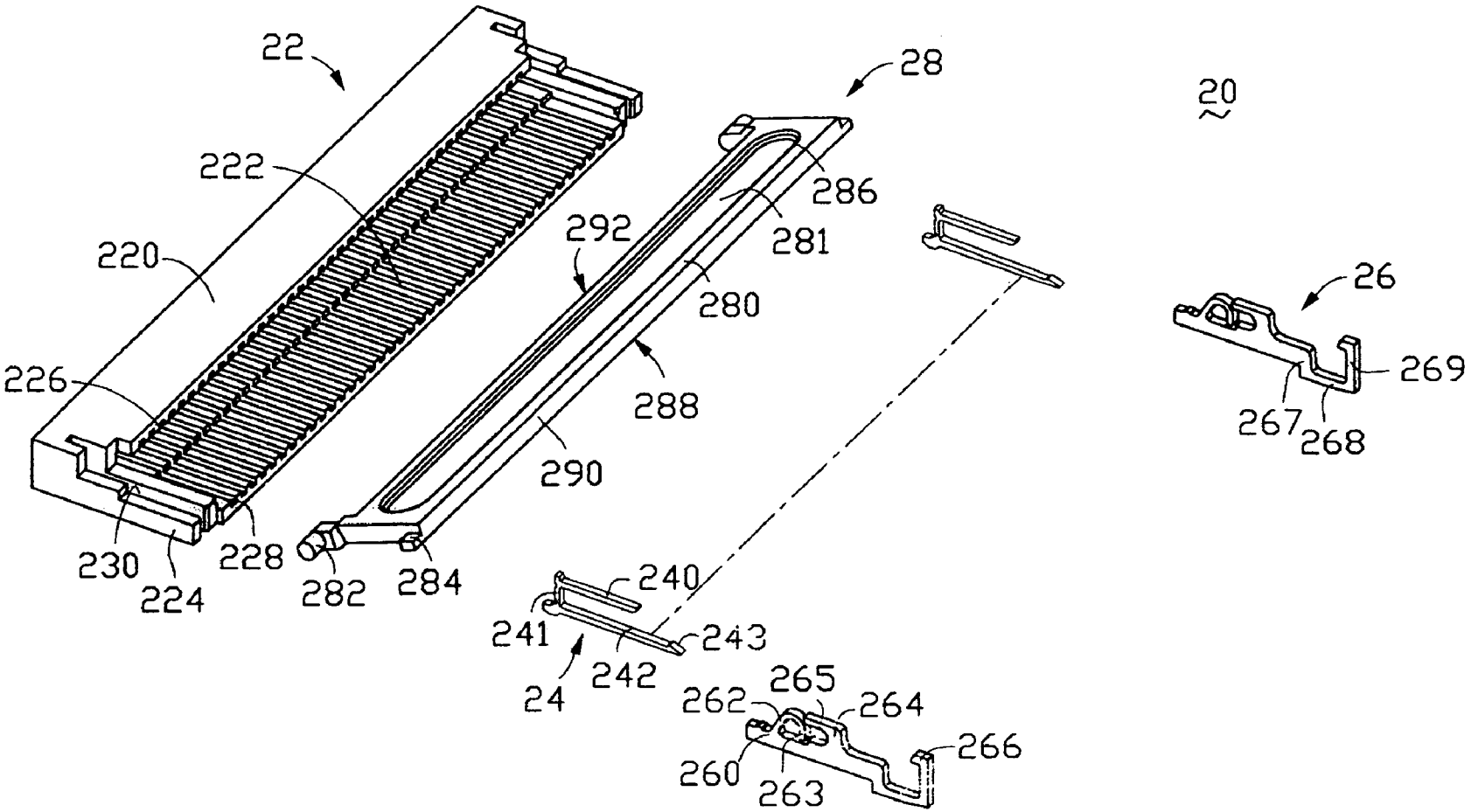
FIG. 1 is an exploded, perspective view of an electrical connector in accordance with the present invention.

Referring to FIG. 1, an electrical connector 20 in accordance with the present invention is provided for electrically connecting a flexible printed circuit (FPC) (not shown) with a flexible printed circuit (not shown). The electrical connector 20 comprises an insulative housing 22, a plurality of electrical contacts 24 received in the insulative housing 22, a pair of metal ears 26 inserted into opposite lateral sides of the insulative housing 22 and an actuator 28 assembled on the insulative housing 22 via pivotally engaging with the metal ears 26.

The insulative housing 22 defines a longitudinal direction and a mating direction perpendicular to the longitudinal direction. The insulative housing 22 comprises a base portion 220, a mating portion 222 extending forwardly along the mating direction from a center of the base portion 220 and two brachial portion 224 extending forwardly from opposite ends of the base portion 220. The base portion 220 defines a plurality of channels 226 arranged in an upper line and a lower line and running through the base portion 220. Each channel 226 in the upper line is face to face with a corresponding channel 226 in the lower line. The mating portion 222 defines a plurality of passages 228 respectively communicating with corresponding channels 226 in the lower line of the base portion 220 and passing through the mating portion 222. Furthermore, the insulative housing 22 defines a pair of slots 230 between each brachial portion 224 and the mating portion 222 and through the base portion 220 rearwardly for receiving the metal ears 26.

Figure 3:
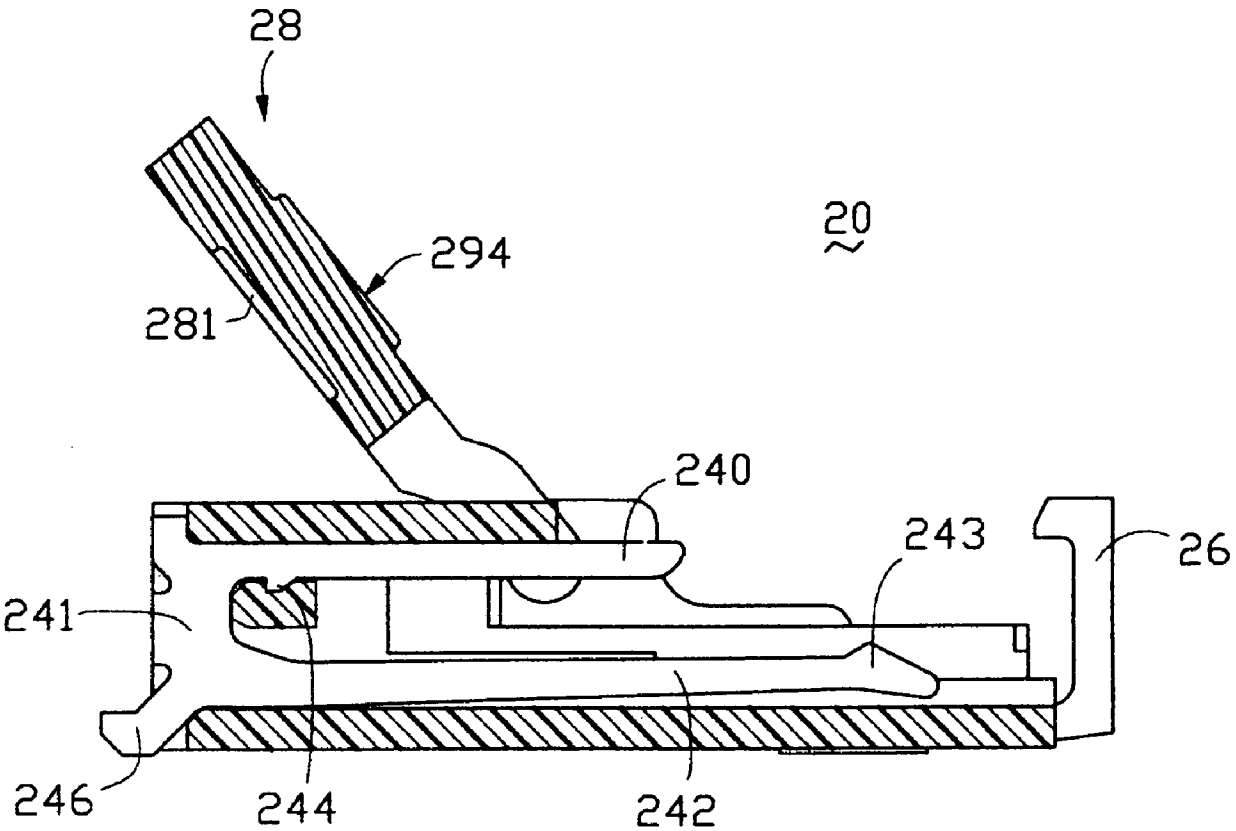
FIG. 3 is a cross-sectional view of the electrical connector, taken along line 3—3 shown in FIG. 2.

Referring to FIG. 1 and FIG. 3, each electrical contact 24 is inserted into the insulative housing 22 from a rear face of the base 220, each electrical contact comprises a horrent portion 241, an upper branch 240 and a lower branch 242 both extending forwardly and horizontally from a same side of the horrent portion 241. The upper branch 240 is received in the channel 226 in the upper line of the base portion 220 with a free end extending beyond the base portion 220, and the lower branch 242 is received in the corresponding channel 226 in the lower line and further extending into the passages 228 of the mating portion 222. The upper branch 240 is formed a stab 244 interferentially engaging with a inner sidewall of the channel 226 to prevent the electrical contacts 24 from exiting out of the insulative housing 22. The lower branch 242 is formed with a contact portion 243 on a free end for electrical contacting with conductor pads of the flexible print circuit and shakable in an up and down direction. The horrent portion 241 has a soldering portion 246 extending downwardly and rearwardly from a lower side of the horrent portion 241 for soldering the electrical contact 24 to the print circuit board.

The actuator 28 defines an open position and a close position relative to the insulative housing and has an approximately rectangle board 280, a pair of turning shafts 282 projecting from lateral sides of the board 280 and a pair of blocks 284. The board 280 comprises a top wall 286, a bottom wall 288, a front wall 290 and a rear wall 292 both joining the top wall 286 and the bottom wall 288. The turning shafts 282 are near the rear wall 292. The blocks 284 are disposed symmetrically on opposite sides of the board 280 and near the front wall 290 for engaging with the metal ears 26.

Figure 4:
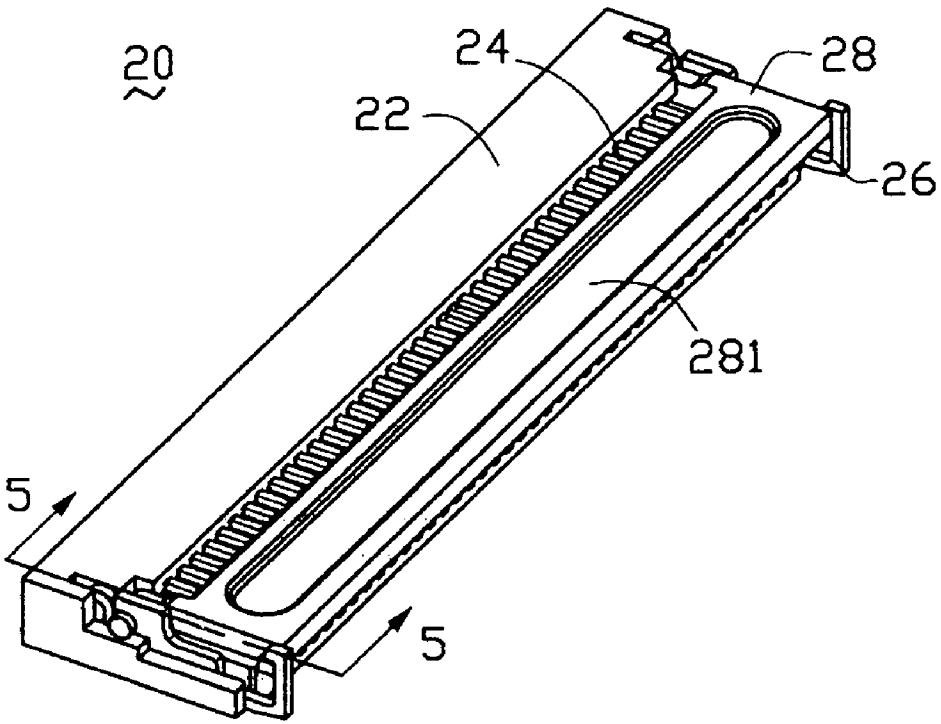
FIG. 4 is an assembled, perspective view of the electrical connector in accordance with the present invention, wherein an actuator of the electrical connector is set in a close position.
Figure 5:
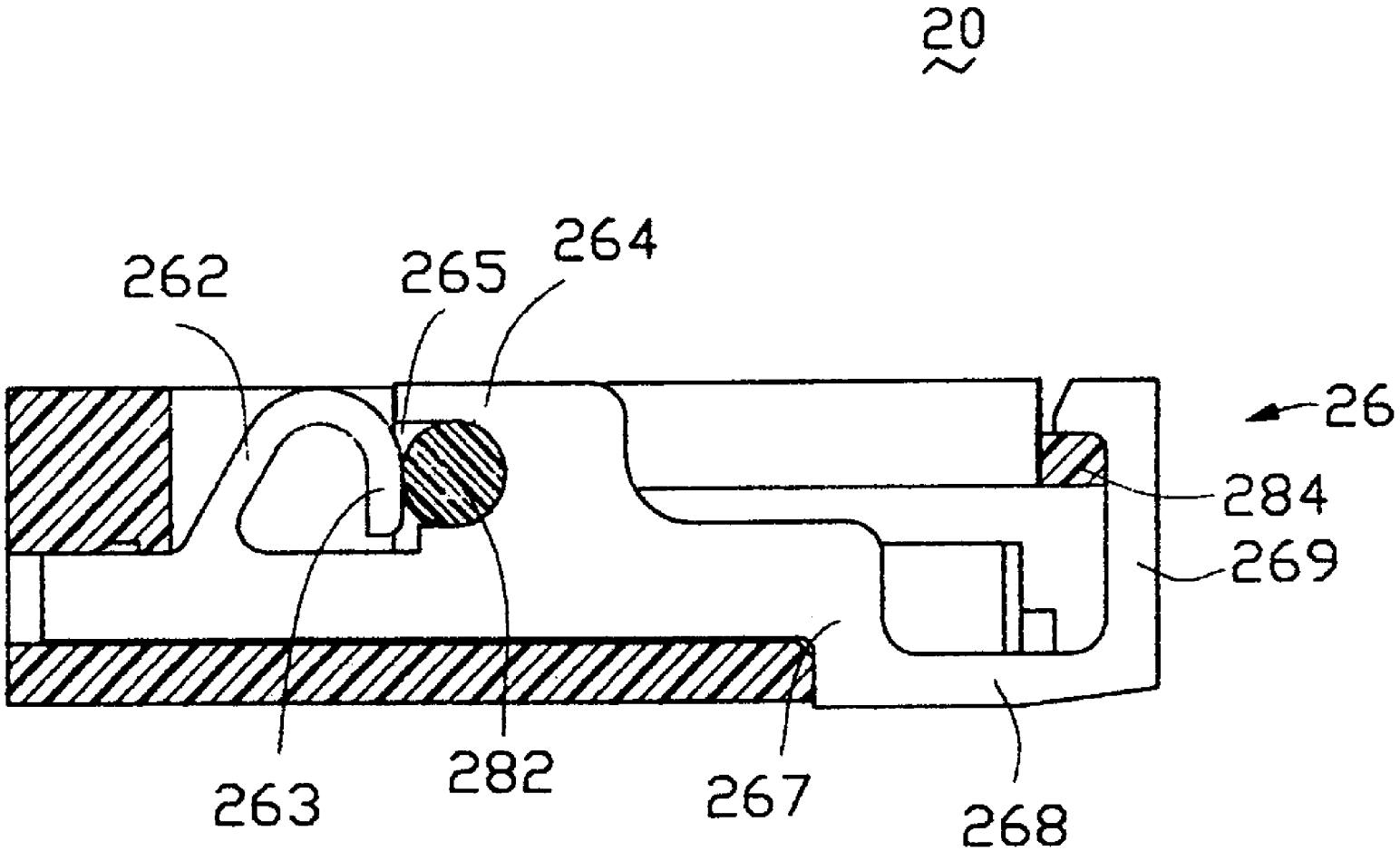
FIG. 5 is a cross-sectional view of the electrical connector taken along line 5—5 shown on FIG. 4.

Referring to FIG. 1, FIG. 3 and FIG. 4, the board 280 is formed with a depressed portion 281 shrinking from a center of the top wall 286 for reducing warp distortion of the actuator 28 and ensure the actuator 28 abutting against the flexible print circuit reliably, and an engaging face 294 opposed to the depressed portion 281 extending from the bottom wall 288 to cover the mating portion 222 of the insulative housing 22 when the actuator 28 is in the close position.

Referring to FIG. 1 and FIG. 3, the metal ears 26 is formed and stamped a metal piece and set in corresponding slots 230 of the insulative housing 22. Each metal ear 26 comprises a main body 260, an elastic arm 262 and a latch arm 264 both extending upwardly and oppositely from an upside of an end of the main body 260 and a claw 266 formed on the other end of the main body 260. The elastic arm 262 is bended forwardly toward the latch arm 264 and downwardly to form a stretch tail 263. The latch arm 264 is bended toward the elastic arm 262 to form a hole 265 together with the stretch tail 263 of elastic arm 262 for receiving corresponding turning shaft 282 of the actuator 28. The shape and dimension of the holes 265 are conformable with the turning shafts 282. When the turning shafts 282 of the actuator 28 are pivotally received in the holes 265 of the metal ears 26, the turning shafts 282 abut against corresponding latch arms 264 by a elastic force of corresponding stretch tails 263 of the elastic arms 262 to prevent the turning shafts 282 from shaking.

The claw 266 of each metal ear 26 is adjacent to an end of the mating portion 222 away from the base portion 220 of the insulative housing 22 in the mating direction. The claw 266 is bended from an end of the main body 260, and has an upright portion 267 extending downwardly from an end of the main body 260, a flat portion 268 extending forwardly from an end of the upright portion 267, a locking portion 269 extending upwardly from an end of the flat portion 268. The flat portion 268 has a soldering portion at a center thereof for soldering the metal ears 26 to the print circuit board to enhance the stability of the connecting between the electrical connector 20 and the print circuit board. And the locking portion 269 is formed with a curve face for leading the actuator 28 moving downwardly.

When assembling the actuator 28 on the electrical connector 20, first, the metal ears 26 are partially received the insulted housing 22, the turning shaft 282 of the actuator 28 are respectively plugged in the holes 265 of the metal ears 26, then the metal ears 26 are completely inserted into the insulted housing 22. Finally the flat portion 268 of the metal ears 26 and the soldering portion 246 the electrical contacts 24 are respectively soldered with the print circuit board. After the electrical connector 20 is assembled, the distance between the rear wall 292 of the actuator 28 and the base portion 220 is further than the distance between the electrical contacts 24 and the base portion 220 to allow the actuator to rotate freely from the open position to the close position.

Figure 2:
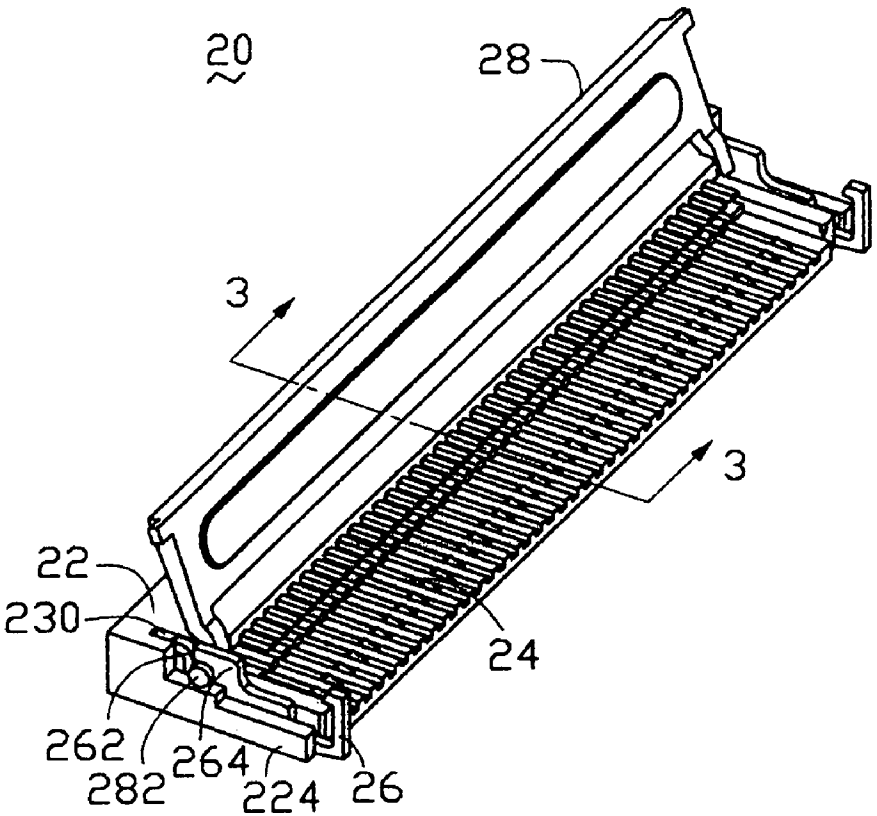
FIG. 2 is an assembled, perspective view of the electrical connector in accordance with the present invention, wherein an actuator of the electrical connector is set in an opening position.

Referring to FIG. 2 and FIG. 4, the actuator 28 is set in the opening position primitively, the flexible printed circuit is inserted into the insulative housing 22 with zero insertion force or low insertion force, at that moment, the flexible printed circuit do not touch the actuator 28. When the actuator 28 is rotated from the opening position to the closed position, the engaging face 294 of the actuator 28 is disposed above the flexible printed circuit. Finally, the actuator 28 is pressed downwardly to bring the claw 266 of the metal ears 26 lock with the blocks 284 thereof, simultaneity, the flexible print circuit board electrical connects with the print circuit board reliably.

During the process of the claw 266 of each metal ear 26 locking with the actuator 28, the claw 266 and the actuator 28 collide with each other in the mating direction. Since the stretch tails 263 of the elastic arms 262 abutting against the turning shafts are elastic, the actuator 28 is allowed to move rearwardly in the mating direction to reduce a distortion of the claw 266 and prevent the claw 266 from yielding. When the actuator 28 is completely locked by the claws 266, the turning shafts 282 are secured in the holes 265, the stretch tails 263 of the elastic arms 262 abut against the turning shafts 282, that arrangement can avoid the turning shafts 282 shaking in the hole 265.

Furthermore, the claw 266 of the metal ears 26 is bended with a extending portion, and the intensity of tension of the claw 266 can be enhance by increasing the length of the extending portion of the claw 266. And the metal ears can be replaced with mounting ears formed from another elastic material.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a flexible printed circuit, comprising:

an insulative housing defining a longitudinal direction and a mating direction perpendicular to the longitudinal direction and having a base portion and a mating portion extending forwardly along the mating direction from the base portion;

a plurality of electrical contacts received in the insulative housing;

a pair of metal ears inserted rearwardly into opposite lateral sides of the insulative housing, each metal ear being formed with a claw on an end thereof adjacent to an end of the mating portion away from the base portion in the mating direction and defining a hole on the other end thereof near the base portion; and an actuator defining an open position and a close position relative to the insulative housing and having a pair of turning shafts pivotally received in corresponding holes of the metal ear, the actuator being locked in the close position by the claws of the metal ears via pressing the actuator near the close position downwardly.

2. The electrical connector as claimed in claim 1, wherein each metal ear has a main body, an elastic arm with a stretch rail and a latch arm extending oppositely from a same side of the main body to define the hole for receiving the actuator together with the stretch tail.

3. The electrical connector as claimed in claim 2, wherein the stretch tail of each metal ear abuts against corresponding turning shaft.

4. The electrical connector as claimed in claim 3, wherein during the claws of the elastic arms locking wit the actuator, the claws and the actuator collide with each other in the mating direction, and the actuator is allowed to move away from the claw in the mating direction by the elasticity of the stretch tail.

5. The electrical connector as claimed in claim 1, wherein the actuator has a pair of blocks extending from opposite lateral sides of an end thereof away from the base portion for locking with corresponding claws of the metal ears.

6. The electrical connector as claimed in claim 1, wherein each metal ear has a main body, the claw is formed by bending an end of the main body away from the base portion in the mating direction.

7. The electrical connector as claimed in claim 6, wherein the claw has an upright portion extending downwardly from an end of the main body, a flat portion extending forwardly from an end of the upright portion and a locking portion extending upwardly from an end of the flat portion and being banded toward the elastic arm at a free end.

8. The electrical connector as claimed in claim 7, wherein the flat portion has a soldering portion at a center thereof.

9. The electrical connector as claimed in claim 1, wherein the actuator has a rectangle board, the board is formed with the turning shafts on opposite lateral sides thereof and defines a depressed portion at a center thereof.

10. The electrical connector as claimed in claim 9, wherein the board of the actuator is formed with an engaging face opposite the depressed portion for pressing the flexible print circuit to the electrical contacts when the actuator is in the close position.

11. An electrical connector comprising:

an insulative housing comprising a base portion and a mating portion extending forwardly from the base portion;

a plurality of electrical contacts retained by the base portion and exposed in the mating portion of the insulative housing;

a pair of mounting ears assembled to the insulative housing, each mounting ear having a main body, an elastic arm and a latch arm, the elastic arm and the latch arm defining a hole together; and an actuator assembled to and retained by the mounting ears fry engaging with the holes and being movable relative to the insulative housing between an open position to expose the mating portion and a close position to cover the mating portion.

12. The electrical connector as claimed in claim 11, wherein each electrical contact comprises a horrent portion with a soldering portion, an upper branch and a lower branch both extending forwardly and horizontally from a same side of the horrent portion.

13. The electrical connector as claimed in claim 12, wherein the lower branch of each electrical contact is longer then the upper branch and is formed with a contact portion exposed in the mating potion.

14. The electrical connector as claimed in claim 11, wherein the elastic arm and the latch arm are extending toward each other from an upside of an end of the main body to define the hole together.

15. The electrical connector as claimed in claim 14, wherein the actuator is formed with a pair of turning shafts respectively received in the holes of the mounting ears.

16. The electrical connector as claimed in claim 15, wherein each elastic arm is formed with a stretch tail abutting against corresponding turning shalt.

17. The electrical connector as claimed in claim 16, wherein each mounting ear is formed with a claw on the other end of the main body and adjacent to an end of the mating portion away from the base portion for locking the actuator in the close position.

18. The electrical connector as claimed in claim 17, wherein during the claws of the, mounting cars locking with the actuator, the claws and the actuator collide with each other in a mating direction, and the actuator is allowed to move away from the claw in the mating direction by the elasticity of the stretch tail.

19. The electrical connector as claimed in claim 18, wherein the claw has an upright portion extending downwardly from an end of the main body, a flat portion extending forwardly from an end of the upright portion and a locking portion extending upwardly from an end of the flat portion and being bonded toward the elastic arm at a free end thereof.

20. An electrical connector for use with a flexible print circuit (FPC), comprising:

an insulative housing comprising a bass portion defining a lengthwise direction thereof and a mating portion extending forwardly from the base portion;

a plurality of electrical contacts retained by the base portion and exposed in the mating portion of the insulative housing;

a pair of holding ears assembled to the housing; and an actuator assembled to the insulative housing with two opposite pivots retained by the holding ears and being essentially rotatable relative to the insulative housing between an open position to expose the mating portion for receiving Said FPC therein, and a close position to cover the mating portion for retaining said FPC therein; wherein said holding car includes a notch receiving the corresponding pivot therein, and a spring arm located around said notch and engaged with the corresponding pivot to allow said corresponding pivot to not only move away from the notch during rotation of the actuator from the open position to the close position for easy assembling of the FPC to the housing, but also move toward the notch when said actuator is in the closed position for holding the actuator and the FPC in position.

* * * * *